US006974357B2

(12) United States Patent
van Mil et al.

(10) Patent No.: US 6,974,357 B2
(45) Date of Patent: Dec. 13, 2005

(54) FLOTATION DEVICE AND METHOD OF MANUFACTURING THE SAME

(75) Inventors: Jeroen Vincent van Mil, Laan van Oud Krelingen 29, Rottordam (NL), NL-3066 HA; Philip Nicolees Bokker, Rottordam (NL)

(73) Assignee: Jeroen Vincent van Mil, Rotterdam (NL)

( * ) Notice: Subject to any disclaimer, the term of this patent is extended or adjusted under 35 U.S.C. 154(b) by 16 days.

(21) Appl. No.: 10/742,339

(22) Filed: Dec. 19, 2003

(65) Prior Publication Data

US 2004/0137810 A1 Jul. 15, 2004

(30) Foreign Application Priority Data

Dec. 20, 2002 (NL) ..... 1022235

(51) Int. Cl.[7] ..... B63C 9/125
(52) U.S. Cl. ..... 441/98; 441/31
(58) Field of Search ..... 441/31, 98, 100, 441/101; 446/220, 221; 222/3

(56) References Cited

U.S. PATENT DOCUMENTS 650,976 A 6/1900 Lavery
3,004,269 A 10/1961 Dillier
3,084,357 A * 4/1963 Gaumer ..... 441/98
3,786,590 A * 1/1974 Weeks ..... 441/31
3,902,425 A * 9/1975 Kutzemann ..... 441/98
4,929,214 A * 5/1990 Liebermann ..... 446/221
5,030,152 A * 7/1991 Carr et al. ..... 441/100
5,941,752 A * 8/1999 Liebermann ..... 446/220

FOREIGN PATENT DOCUMENTS

FR 2551420 3/1985
FR 2733482 10/1996

* cited by examiner

*Primary Examiner*—Lars A. Olson
(74) *Attorney, Agent, or Firm*—Epstein Drangel Bazerman & James, LLP

(57) ABSTRACT

The invention relates to a device for use in retrieving an object, e.g. a pair of spectacles, a key ring or a GPS device, that falls in water. According to the invention the device is provided with a holder that is resistant in regard of spray water and atmospheric humidity in which an inflatable body is enclosed. In the event of activation of the device, the formation of gas required for the exertion of a flotation or driving force occurs within the inflatable body itself. The reagents required for the gas formation are preferably provided in mutual separation within the inflatable body.

51 Claims, 16 Drawing Sheets

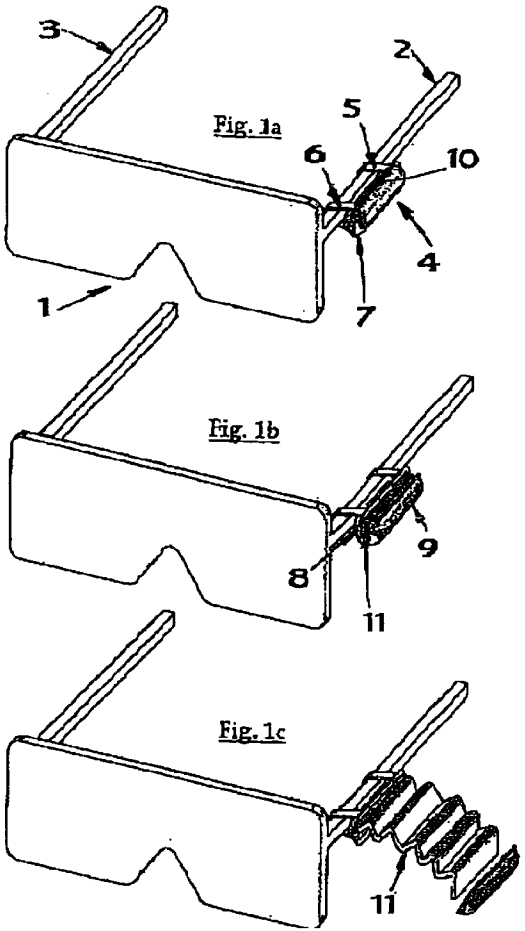
Fig. 1a
Fig. 1b
Fig. 1c
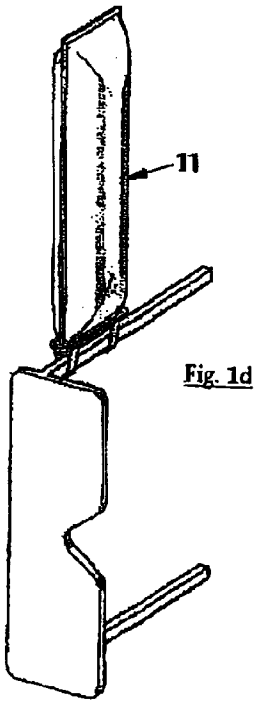
Fig. 1d

FLOTATION DEVICE AND METHOD OF MANUFACTURING THE SAME

This application claims priority of pending Netherlands application number NL 1022235 filed on Dec. 20, 2002.

BACKGROUND OF THE INVENTION

The invention relates to a device for use in retrieving an object that falls in water or in saving a person who falls in water, whereby the device is provided with means for attaching the device to the object to be retrieved or means with which the person to be saved can carry the device with him, respectively, (and provided) with a spray water-resistant holder that comprises a mechanism for opening of the holder, which holder in its closed state encompasses an empty, inflatable body of a substantially gas-impermeable matter in a folded state, and with one or more reagents which react under the influence of water that has entered the holder to form a gas, which gas serves for filling the folded inflatable body in order to exert a flotation or driving force on the object attached to the device or on the person carrying the device.

A device for use in retrieving an object that falls in water is known from the French patent publication FR-2733482. This known device is cylindrical-shaped and it comprises a disc which at one of its surfaces is provided with a tube that extends perpendicularly with respect to the disc surface. The diameter of the tube is smaller than the diameter of the disc. The assembly of the disc and tube is surrounded at the side of the free end of the tube by a cover which has a mainly cylindrical form and of which the diameter is slightly larger than that of the disc, and of which the height is greater than that of the tube. The cover at its open end facing the disc fits well around the disc, thus encompassing the tube on the inside of the cover. The disc at its circumference is attached to the cover with the aid of means that open when these come into contact with water, in this case the means are formed by plugs of sodium chloride. The disc at its side facing the interior of the cover, and thereby lying within the diameter of the tube, is provided with a number of openings which connect the inside of the tube to the outside of the disc and the device. The openings, too, are provided with closure means that open when they come into contact with water, in this case the closure means are also plugs of sodium chloride. The bottom of the tube that is provided with the openings on the side of the disc is filled with a tampon of surgical cotton, a strong and hydrophilic material. There is a reaction body at the top side of the tampon, in the interior of the tube, which consists of a matter that, when it comes into contact with water, undergoes a chemical reaction and thereby forms a gas. In the known device it is calcium carbide which reacts with water to form acetylene and calcium hyroxide. The inside of the tube at its end facing away from the disc is closed with a grating that keeps the tampon and the reaction body packed together against the bottom of the tube. There is an inflatable bag provided at the free end of the tube. The opening of the bag, which is in a closed state, is attached to the outside of the free end of the tube. In a resting state, the folded bag in the inside of the cover lies around the tube. Finally, there is also a ring on the outside of the cover for attaching the device to the object to be retrieved, in this case a key.

The operation of the known device is as follows. When the object to be retrieved in question, such as a key, falls in water, then it sinks due to its mass. Because the key has a higher density than that of the device, the key comes to hang on the underside when it sinks. During the sinking, the plugs of sodium chloride which connect the disc and the cover to each other, dissolve in the water. The plugs of sodium chloride which connect the openings between the disc and the interior of the tube provided within the cover, to each other also dissolve in the water. This allows water to enter in the tampon and the water is absorbed by the tampon. The reaction body thus comes into contact with water by means of the tampon. Gas is created through the above-mentioned reaction, with the gas escaping through the grating to the inflatable bag to thereby fill the bag. The tampon serves two functions, namely absorbing the water that comes into the tube and—especially while water is being absorbed in the tampon—restricting that the formed gas escapes from the bag or the tube through the openings in the disc to the outside. During the sinking of the object in the water, whereby the disc hangs underneath because of the key which hangs on the disc, the disc detaches from the cover, thereby also aided by the pressure exerted by the formed gas. When sufficient gas has been formed and the bag has inflated sufficiently with this gas, a flotation force arises that allows the key hanging on the disc to rise to the surface.

A disadvantage of the known device relates to the cover. The volume of the cover on the one hand should be sufficiently large to be able to contain a sufficiently large bag and on the other hand be small and lightweight since it will come to hang on the object to be retrieved.

Because the bag that is to be stored in the cover must not be too large, this aspect also lays a limit on the flotation power which can be effectuated through the known device. As such, only small, light weight objects can be floated with it.

Another disadvantage of the device relates to the speed with which the device can come into action. Under certain circumstances, such as when sailing, there is a risk that the inflatable body will be unnecessarily inflated. The openings in the disc which are closed with plugs of sodium chloride, can lose their closing function at conditions of sufficient atmospheric humidity, since sodium chloride is hygroscopic. There are also objections against the use of acetylene, the gas that provides for the flotation or driving force, with the known device. A mixture of acetylene and oxygen is explosive, acetylene is toxic and it also has an unpleasant odour. Another disadvantage relates to the durability of the operability of the device, considering that acetylene is very sensitive in regard of humidity.

Another disadvantage of the known device relates to the valve function with which entry of water in the cover is regulated. This valve function is provided by a number of parts, namely the plugs of sodium chloride with which the openings have been closed and the tampon on the inside of the tube which absorbs the water entering through the openings. If the tampon for whatever reason is drenched insufficiently by which the entering water does not or not sufficiently reach the reaction body, then the reaction will not start or propagate, respectively, so that the intended operation will not occur. The tampon acts as a water barrier when water is taken up in it. So some of the formed gas always diffuses through the tampon and through the openings to the outside. If the tampon thus does not absorb sufficient water across the whole of its breadth, then the eventually formed gas will escape along the tampon and the openings in the disc on to the outside.

SUMMARY OF THE INVENTION

It is an objective of the invention to provide for an improved device of the type described in the pre-amble that is compact and lightweight.

It is another objective of the invention to provide for an improved device that can be made in different shapes.

It is also an objective of the invention to provide for an improved device which during operation can be inflated very rapidly.

It is still another objective of the invention to provide for an improved device which can exert a large flotation force that is sufficient for floating heavy objects or persons.

It is further another objective to provide for an improved device which in its uninflated state can retain its potential working during a long period of time.

It is further yet another objective to provide for an improved device which in its inflated state can maintain the flotation force exerted by it during a long period of time.

It is also an objective of the invention to provide for an improved device which can be manufactured by a quick and cheap method.

According to an aspect of the invention of or more of the stated objectives are achieved by a device of the type described in the pre-amble, characterized in that, the reagents which under the influence of water form gas are comprised within the substantially gas-impermeable inflatable body itself and (that) the inflatable body comprises a water-permeable substance. The large surface area of the inflatable body available with the device itself can thus be utilized for a rapid uptake of water required for the gas formation. This is accompanied by the advantage, that first after the water-permeable substance of the inflatable body is in a state whereby water is taken up, it begets substantially closed pores and thus becomes impermeable in regard of the gas that is to be formed within the device. The inflatable body thereby retains its main function, namely that of containing the formed gas.

Some examples of water-permeable substances that are suitable for application according to the invention, are—non-limitatively—: paper types that are strong when wet, fine-woven linen, substances comprising cellulose fibres or polyester fibres such as used for cleaning tissues. Also so-called "non-woven" matter is generally suitable for application according to the invention. "Non-woven" matter should understood to include fibre-comprising matter, that is not shaped in threads, and of which the fibres are mutually orientated in a particular direction, or otherwise are orientated at random, and which are bound to each other, such as by means of friction and/or cohesion and/or adhesion.

In a preferred embodiment, the water-permeable substance of the substantially gas-impermeable inflatable body is water-absorbing. The advantage hereof is, that water entering the inflatable body can be quickly spread across the interior of the inflatable body.

In a preferred embodiment the water-permeable substance of the substantially gas-impermeable inflatable body has a predetermined-overpressure releasing function. This offers the advantage, that through choice of a suitable water-permeable substance for the inflatable body, when the device falls in water, entry of water can continue till a predetermined counter pressure due to the then therein present gas arises. Another advantage hereof relates to the development that when the device sinks deeply in water and it thereby takes up sufficient water so that the gas-forming reaction occurs, as the propagating gas-forming reaction takes place a growing flotation force is exerted. During the ascent of the device or the person in question towards the surface as a result thereof, the pressure within the then inflated body will keep increasing. A possible explosion of the inflated body is thus prevented by appropriate choice of the pressure value below which the inflated body needs to be kept.

In a further preferred embodiment the water-permeable substance of the inflatable body is provided with a swelling agent. This swelling agent serves to enhance that after entry of sufficient water in the inflatable body the pores of the water-permeable substance are closed better.

In a still further preferred embodiment the water-permeable substance of the inflatable body comprises the substance which is commonly available under the trade name Sontara®. Sontara® is a plastic, supplied by Dupont, which also fulfills the two above-mentioned requirements in regard of absorbing water quickly and well and, when water has been absorbed, gaining closed pores in a substantial measure. In further embodiments, the substantially gas-impermeable inflatable body can comprise combinations of different water-permeable substances, either with or not in combination with plastics such as polypropene and polyethene.

It shall be clear that in principle every substance that can allow water through well and quickly is suitable for use in the device according to the invention. A desirable property of the water-permeable substance relates to the absorbability of water: when water has been taken up in the water-permeable substance, then the substance must obtain substantially closed pores. Other further desirable properties of the water-permeable substance are that the substance, when wet, has sufficient mechanical strength, and that it can be folded or rolled compactly when in a dry state, and that it can be provided with a good sealing of a seam.

In a further embodiment the inflatable body as in its folded state can be provided with means for enhancing the eventual unfolding of the inflatable body, such as a string or a spring. This offers the advantage, that at propagation of the gas-forming reaction the body can unfold faster and the body therefore can be inflated faster.

According to another aspect of the invention, the inflatable compartment is divided into compartments and it is provided in one or several of these compartments with one or more reagents that react under the influence of water that has entered the holder to form the gas that causes a flotation or driving force. This offers the advantage, that the gas-forming reaction can occur in different places simultaneously and that gas can be formed. This development enhances that the folded inflatable body can unfold faster. Another advantage is that it does not make any difference from which side water enters the inflatable body, since the gas-forming reaction shall occur anyhow.

According to still another aspect of the invention, the one or more reagents that react under the influence of water to form the gas that brings about a flotation or driving force, are mutually separated within the compartment in which they have been provided. This offers the advantage, that the durability of the reaction potency is retained for a long period of time, since the gas-forming reaction will occur then and only then when all reagents required for the gas formation come into contact with each other. Another advantage hereof is, that in particular with an endothermic gas-forming reaction, freezing of the reaction in part of the inflatable body can be prevented. Application of this measure increases the certainty of operation of the device according to the invention.

In a preferred embodiment the mutual separation of the reagents comprises a water-soluble substance such as a polyvinyalcohol, for example in the form of a separation layer. The advantage hereof is that all reagents required for the formation of gas will come into contact with each other then and only then after sufficient water has entered the inflatable body for dissolving the separation layer. If the object concerned falls in shallow water and it is collected quickly again, or if the person concerned can quickly find his feet again in the water, then there will be little opportunity for sufficient water entering the holder. Under these circumstances the device, or at least a part of the device, does not need to be inflated. Conversely, if the object concerned or the person concerned falls in deep water, then sufficient water will enter the holder by which the required flotation force will be exerted sufficiently quickly.

According to another aspect of the invention, the arrangement of the compartments, and within the compartments (the arrangement of) the one or more reagents which react under the influence of water entering the inflatable body to form the gas that causes a flotation or driving force is such, that the gas formed at the start of the reaction can fill the body partly and thereby bring about a draught or "chimney" effect by which the reaction can propagate. The advantage hereof is that a draught can be created so that the reaction can propagate instead of dousing as well as that the first formed gas can be utilized for the further unfolding of the inflatable body. The achievable draught effect is dependent on inter alia the shape and the size of the inflatable body, the manner of folding and enclosure thereof in the spray water-resistant holder and on the eventual application of mechanical ancillary means such as a string or spring for enhancing that a body that is partly inflated by the formed gas unfolds faster.

According to yet another aspect of the invention the mechanism for the opening of the spray water-resistant holder comprises at the outer surface of the holder a substance that is not soluble in humidity and soluble in water, such as e.g. a polyvinylalcohol. This substance can be in the form of, for example, an attachment layer that keeps two co-operating halves of an elongate device that are provided along its longitudinal direction, together till the device falls in water. This offers the advantage that the holder does not open due to the first (spats of) spray water, but that it opens first after the water-soluble attachment has dissolved along a sufficient length thereof and it releases the inflatable body encompassed in the holder.

In a preferred embodiment the layer of the substance that is not soluble in humidity and soluble in water comprises a substantial part of the outer surface of the spray water-resistant holder. This offers the advantage that when, after a fall in water, the holder is required to open, dissolution of the attachment layer can occur at several places simultaneously, by which the inflatable body encompassed within the holder is released all the faster for it. In extension, there is also the advantage that the faster the inflatable body is released, the faster it can be inflated with the gas to be formed and the faster the required flotation force can be exerted.

In yet another embodiment the spray water-resistant holder comprises a water-soluble plastic foil, preferably a printable and bio-degradable plastic foil. This offers the advantage that the holder can be given a visually attractive appearance and that the holder can be made environment-friendly.

In a number of preferred embodiments the device has an elongate shape or a folded shape such as a zig-zagged shape, so that it can be attached to e.g. an arm of a pair of spectacles or to a key ring. In principle, the device can be provided in any choice of shape that allows a large inflatable body to be provided in a folded shape in the holder. For use of the device for saving a person, the device can be embodied in the form of a life jacket or another item of clothing, such as a T-shirt, shirt or pair of trousers. Here too the device can be provided in sections of the item of clothing, such as e.g. only in the collar. The advantage of providing the device in a life jacket or an item of clothing is that as long as the person is not in water, the life jacket or item of clothing stays un-inflated and thin and that it thus can be worn with a certain measure of freedom of movement and (measure of comfort. An item of clothing hereby does not necessarily have to be provided with the device according to the invention on the whole of its surface. Under certain circumstances it could suffice to provide a number of parts with the device, such as the collar and/or the sleeves of a shirt.

The device according to the invention can of course also be used for vehicles and vessels, for example in the form of a number of holder which are released from a cluster only under certain circumstances and which can be inflated only thereafter in order to keep the vehicle or vessel afloat.

Finally, according to another aspect the invention also relates to a method of manufacturing a device for use in retrieving an object that falls in water or in saving a person who falls in water, whereby the method comprises the following steps:

forming an outer layer of matter, which in regard of its mechanical strength and rate of dissolution in water is suitable for the side of the device that is to be eventually exposed to water, in a mould, providing adjacent to the outer layer a layer of water-permeable substance, preferably of a water-permeable substance which is also water-absorbing, providing an inner layer of water-soluble substance such as a polyvinylalcohol, which water-soluble substance preferably has a lower melting temperature than that of the outer layer, on the side adjacent to the layer of water-permeable substance and facing away from the outer layer, and applying heat and/or pressure for melting the three layers such that the matter of the inner layer preferably is melted into the layer of water-permeable substance.

This offers the production-related advantage that the device can be produced in large numbers and at small cost.

BRIEF DESCRIPTION OF DRAWINGS

The inventive concept will now be described in detail and further embodiments will be described with reference to an example and its related drawings. The drawings depict the following:

FIGS. 1*a–e* show an embodiment of the device according to the invention, which has been provided on a pair of spectacles, at the start and at later stages of the activation of the device.

DETAILED DESCRIPTION OF THE INVENTION

Figure 1E:
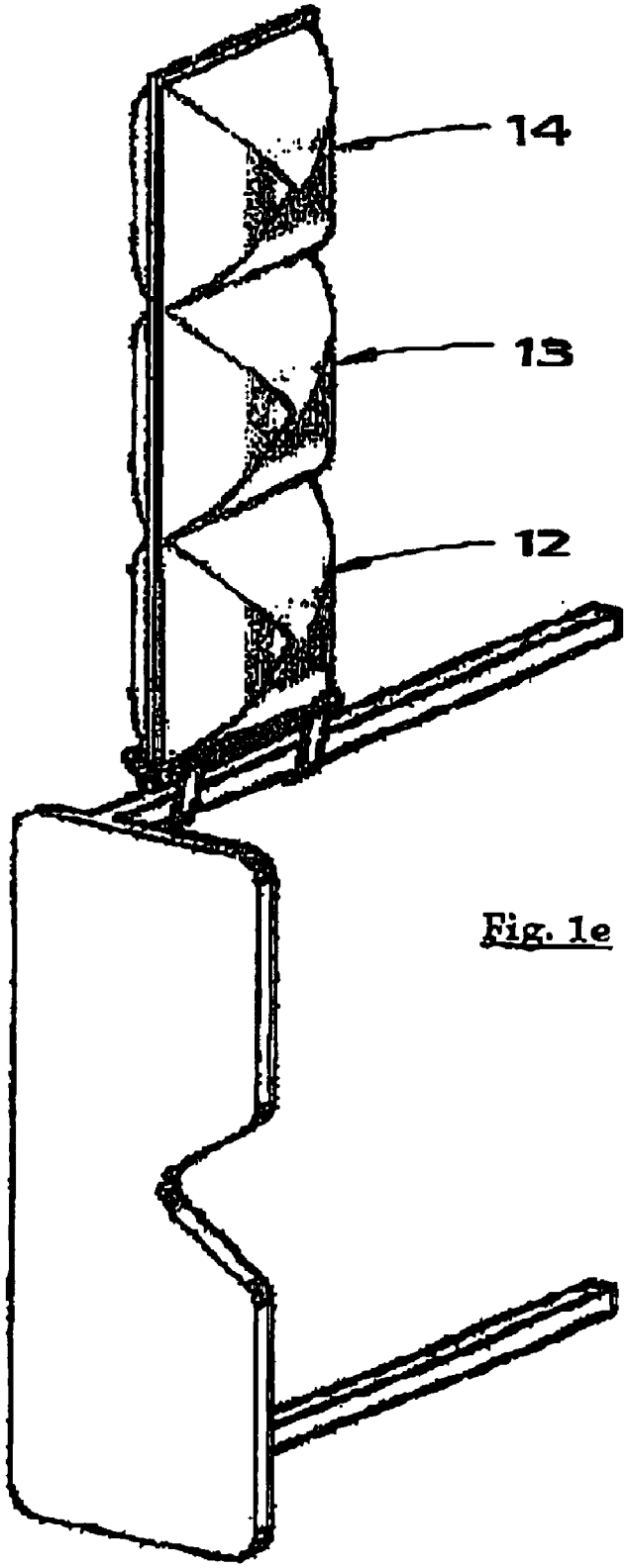

The drawings are schematic and are not drawn to scale. In the drawings the same numbers refer to corresponding parts of the depicted embodiments of the device.

FIGS. 1*a–e* show an embodiment of the device according to the invention, which has been provided on a pair of spectacles, at the start and at later stages of the activation of the device. FIG. 1*a* shows a pair of spectacles 1 with two arms 2, 3. A device 4 according to the invention has been provided on one of the arms, in this case e by means of two detachable, so-called strips of Velcro 5, 6. The device 4 comprises an elongate tube 7, made from two halves 8, 9 which are kept together by means of a joining seam 10, for example formed by thermal welding. The tube 7 thus serves as a spray water-resistant holder. The joining seam 10 comprises a polyvinylalcohol that is not soluble in humid air and soluble in water, and it thus serves as a mechanism for the opening of the holder. There is an inflatable body 11 provided in the tube 7. When the pair of spectacles fall in water, then the joining seam 10 will dissolve and have the two halves 8, 9 move away from each other, as shown in FIG. 1*b*. After some time the inflatable body 11, which initially is encompassed in a zig-zag shape within the tube 7, shall unfold. The unfolding of the inflatable body is enhanced when the one half 9 of the tube 7 comes off the other half 8 of the tube 7, as shown in FIG. 1*c*. FIG. 1*d* depicts the pair of spectacles at a stage whereby the reagents in the inflatable body under the influence of water that has entered the inflatable body have led to the formation of gas, which gas in the meantime has filled the inflatable body and made the pair of spectacles rise to the water surface. FIG. 1*e* shows a device which comprises an inflatable body that has been divided in a number of compartments 12, 13 and 14.

Figure 2A:
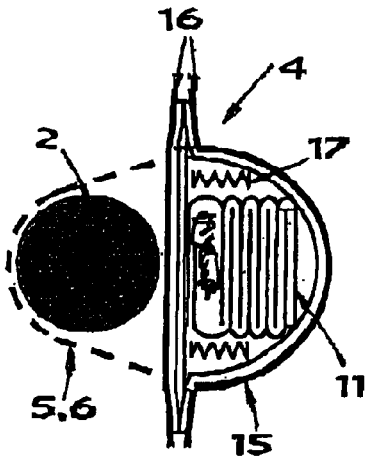
FIGS. 2*a–b* show a view of a cross-section of the pair of spectacles and the device according to FIGS. 1*a* and 1*e,* respectively.
Figure 2B:
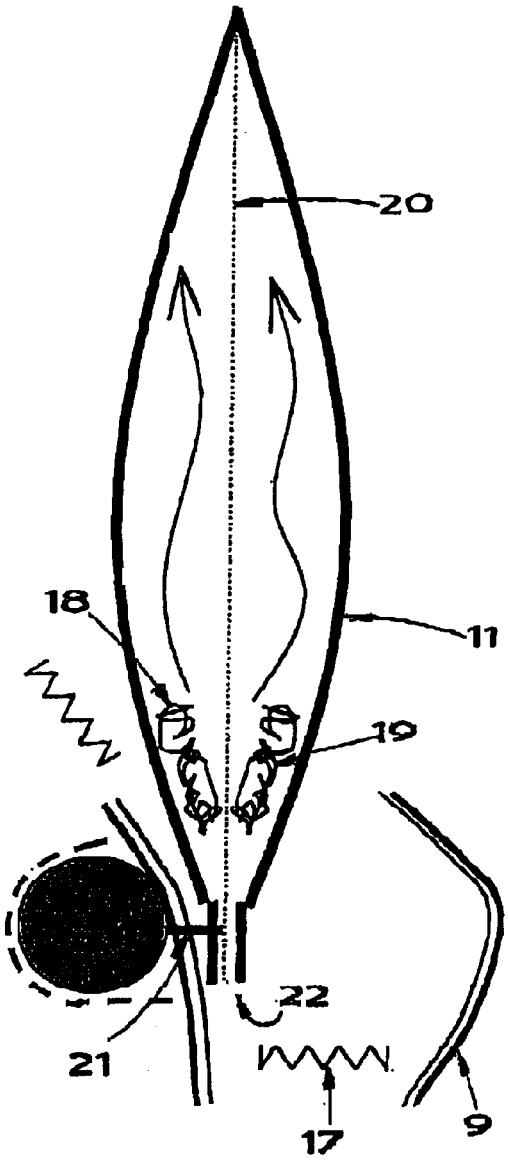

FIGS. 2*a–b* show a view of a cross-section of the pair of spectacles and the device according to FIGS. 1*a* and 1*e*, respectively. FIG. 2*a* depicts the arm 2, and the device 4 that has been attached to by means of strips 5, 6. The device 4 comprises a holder 15, which comprises an outer layer of polyethene 16. The holder 15 as depicted in its closed state shows an empty, substantially gas-impermeable inflatable body 11 and it further comprises a number of springs 17 as ancillary mechanical means for enhancing the unfolding of the inflatable body. The inflatable body is in a state in which it is folded into a zig-zag shape. The inflatable body 11 comprises two reagents that react with each other and are gas-forming when under the influence of water. FIG. 2*b* depicts the inflatable body at a stage in which it is already partly filled with gas. The gas is formed due to the reagents 18, 19 which are provided, have come into contact with each other after the separation 20 (denoted by the broken line) between the reagents has dissolved in water that has entered the inflatable body. The separation 20 in this example is formed by a layer of polyvinylalcohol. FIG. 2*b* also shows the connection 21 of the inflatable body to the holder. The connection 22 between the various layers of which the inflatable body is made, is also depicted. In this example the connection is a ultrasonically made seam the advantage of a ultrasonically made seam is that it pointedly does not dissolve and thus offers more adherence in comparison to a thermically formed seam.

Figure 3B:
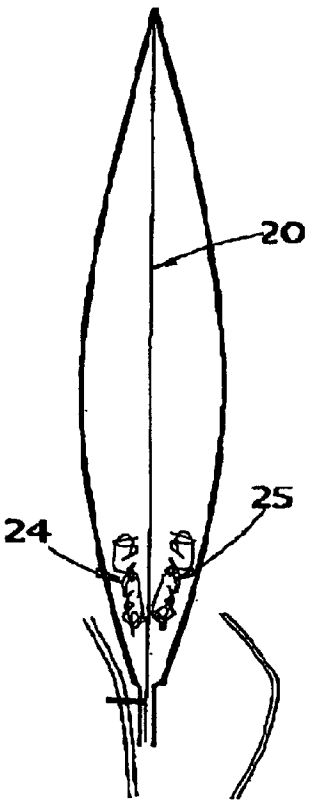
FIGS. 3*a–b* show an embodiment of the device whereby the inflatable body comprises the substance Sontara®.
Figure 3A:
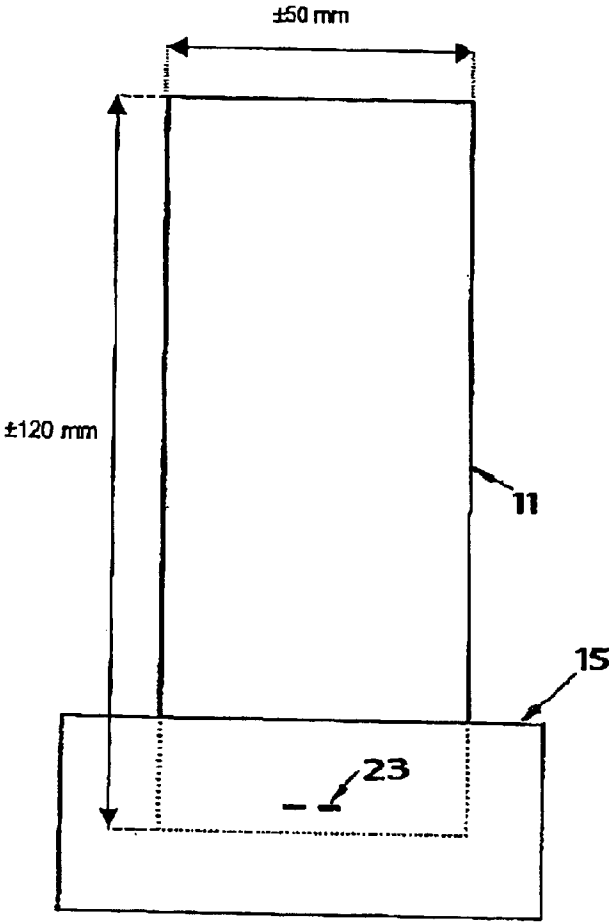

FIGS. 3*a–b* show an embodiment of the device whereby the inflatable body comprises the substance Sontara®. FIG. 3*a* shows that the connection 21 according to FIG. 2*b* is formed by means of a staple 23 between the holder 15 and the inflatable body 11. In this example the reagents 24, 25 for forming the required gas are tartaric acid and sodium bicarbonate. Of course, all sorts of reactions may be utilized for forming the gas required for floating the device. According to FIG. 3*b* the tartaric acid and the sodium bicarbonate have both been provided free in the inflatable body 11. The gas-forming reaction takes place as soon as the layer of polyvinylalcohol 20 that separates the reagents mutually, dissolves.

Figure 4B:
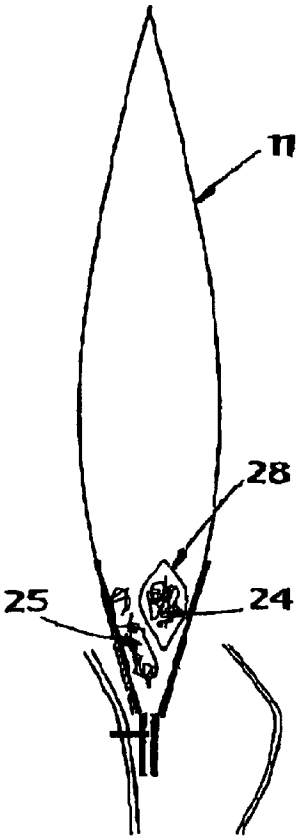
FIGS. 4*a–b* show an embodiment of the device whereby the inflatable body comprises a combination of the substance Sontara® and low-density polyethene.
Figure 4A:
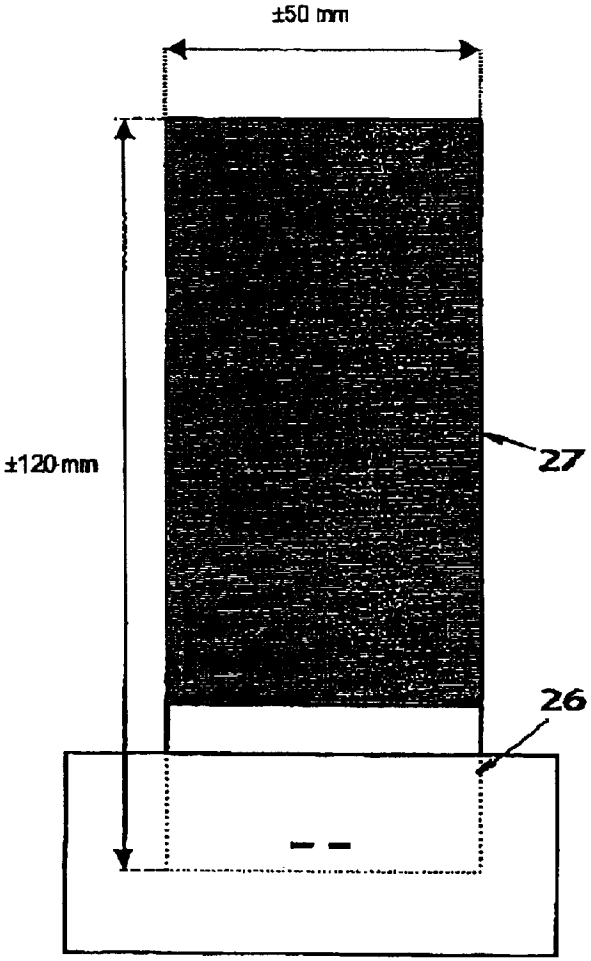

FIGS. 4*a–b* show an embodiment of the device whereby the inflatable body comprises a combination of the substance Sontara® and low-density polyethene. This combination provides the advantage that when most of the water that is required to enter the inflatable body has entered through the Sontarag®-comprising part, the manner of gas formation and the rate of gas formation and the unfolding of the inflatable body during propagation of the gas formation can be directed. Such a combination whereby, after activation of the device, the Sontara®-comprising part 26 of the inflatable body 11 which lies partly in water, ensures directed entry of the water, and the polyethene-comprising part 27 ensures good gas-impermeability, provides the advantage of a long-lasting floating power. According to FIG. 4*b* the tartaric acid 24 has been provided within a bag 28 of polyvinylalcohol, which bag 28 also dissolves in the water that enters the inflatable body 11. In this example, the sodium bicarbonate 25 is provided lying free in the inflatable body 11. The depicted mutual separation of the reagents, by means of the separation layer 20 or the bag 28, is favourable in regard of the stability, a long retention, of the reaction potency.

Figure 5B:
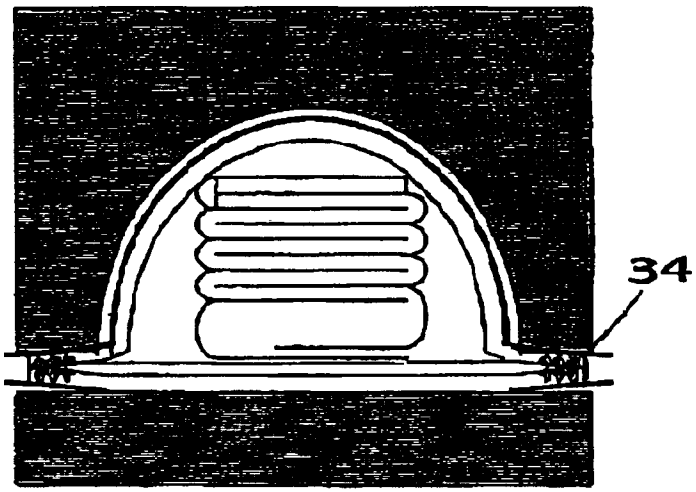
FIGS. 5*a–b* depict two instances during the execution of a method of manufacturing the device according to the invention.
Figure 5A:
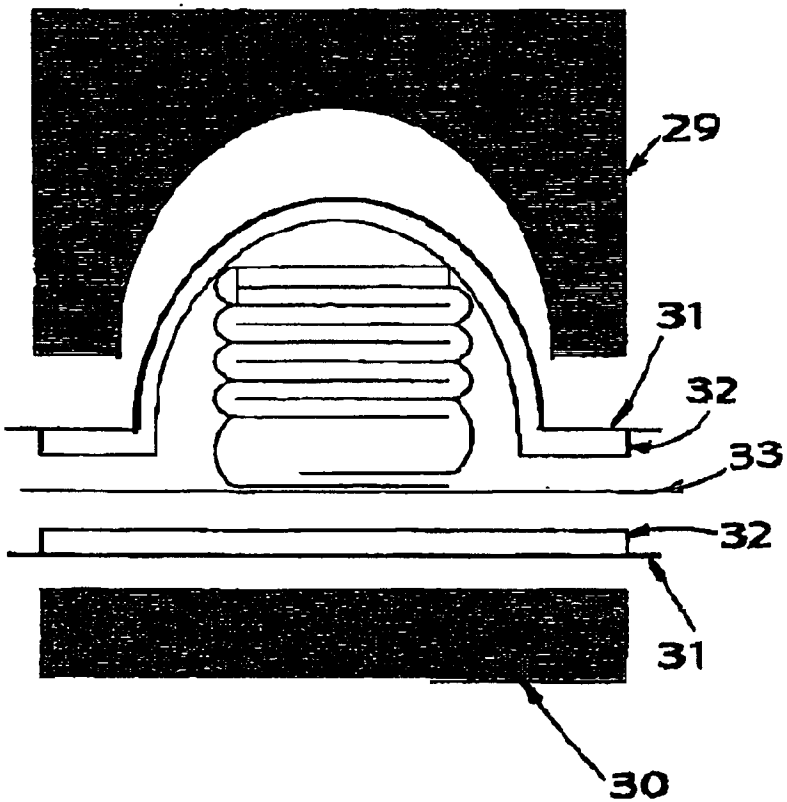

FIGS. 5*a–b* depict two instances during the execution of a method of manufacturing the device according to the invention. FIG. 5*a* depicts how a double-sided laminate arrangements provided for within the two halves 29, 30 of a mould with—as seen from the outside toward the inside of the mould—consecutively polyethene 31, Sontara® 32, the inflatable body 11 folded in a zig-zag shape and which incidentally is provided with the gas-forming reagents (not shown), and a layer of polyvinylalcohol 33. FIG. 5*b* depicts how after application of the heat and/or pressure required for the co-formation of the various constituting parts of the device, the polyvinylalcohol in the layer of Sontara® has been melted in at points 34, with the accompanying advantage the melt-in provides for mechanical strength. Another advantage hereof is that the water that is to enter in the inflatable body is let through quickly by the Sontara® and (is) absorbed by which the polyvinylalcohol that has been melted into the Sontara® quickly comes into contact with the water en thus can dissolve quickly in the same. It shall be clear that the inflatable body 11 can be provided compactly within the holder in all sorts of folding states.

Figure 6:
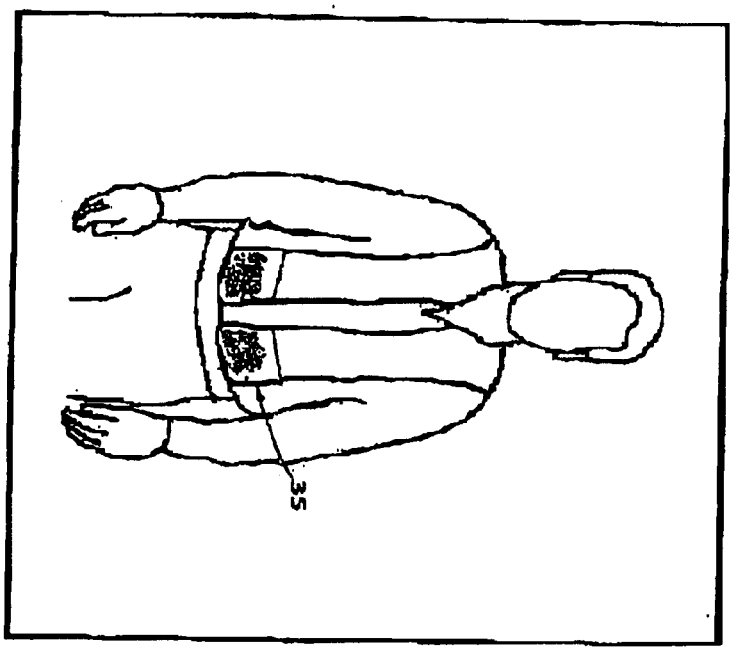
FIG. 6 depicts a life jacket which is provided with a device according the invention.

FIG. 6 depicts a life jacket 35 that is provided at its underside with a device according to the invention. As long as the life jacket does not need to be inflated it is compact and lightweight and it affords its bearer freedom of movement and a comfortable wear.

Figure 7:
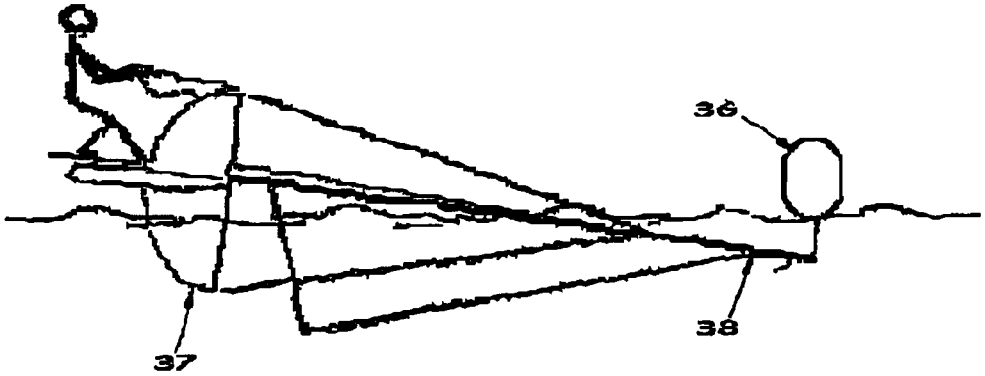
FIG. 7 depicts a mast buoy that is provided with a device according to the invention.

FIG. 7 depicts a mast buoy 36 that is provided with a device according to the invention. The device, for example in the shape of a tennis ball, can be provided on a vessel 37, and it is activated then and only then when the vessel capsizes and to be inflated at that time to a size which provides the top of the mast with sufficient floating power and for example also with visibility.

Figure 8:
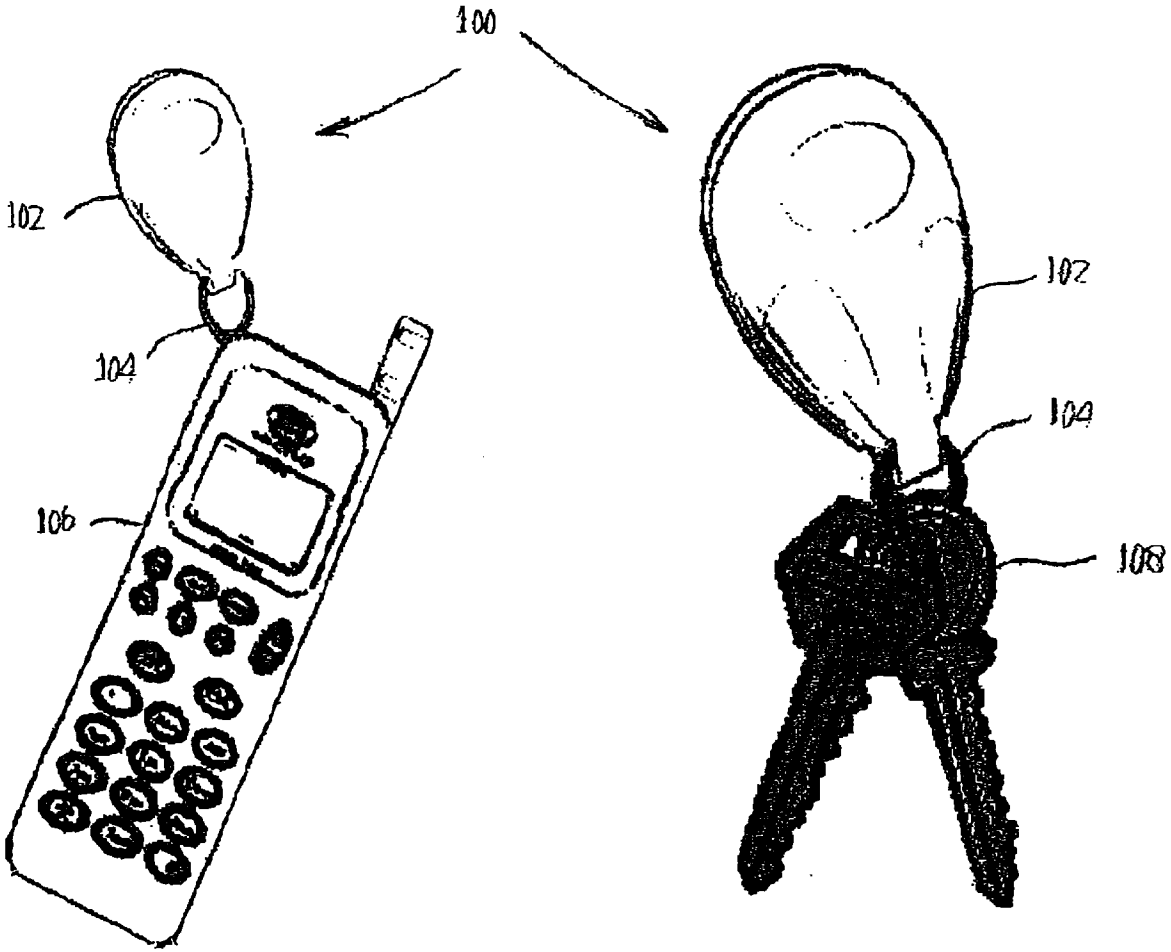
FIG. 8 depicts another embodiment of the device according to the invention, which is suitable for use with a diversity of objects such as mobile phones and keys.

FIG. 8 depicts schematically another embodiment of the device according to the invention, which is suitable for use with a diversity of objects such as mobile phones and keys. FIG. 8 depicts at the left-hand side the device 100, its holder 102, and a ring 104 for attaching the holder 102 to a mobile phone 106. FIG. 8 depicts at the right-hand side the device 100, its holder 102, and a ring 104 for attaching the holder 102 to a number of keys 108. In use of the device according to the invention, it is possible to retrieve a mass of several hundred grams in about 10 to 20 seconds after the mass has fallen in water.

Figure 9:
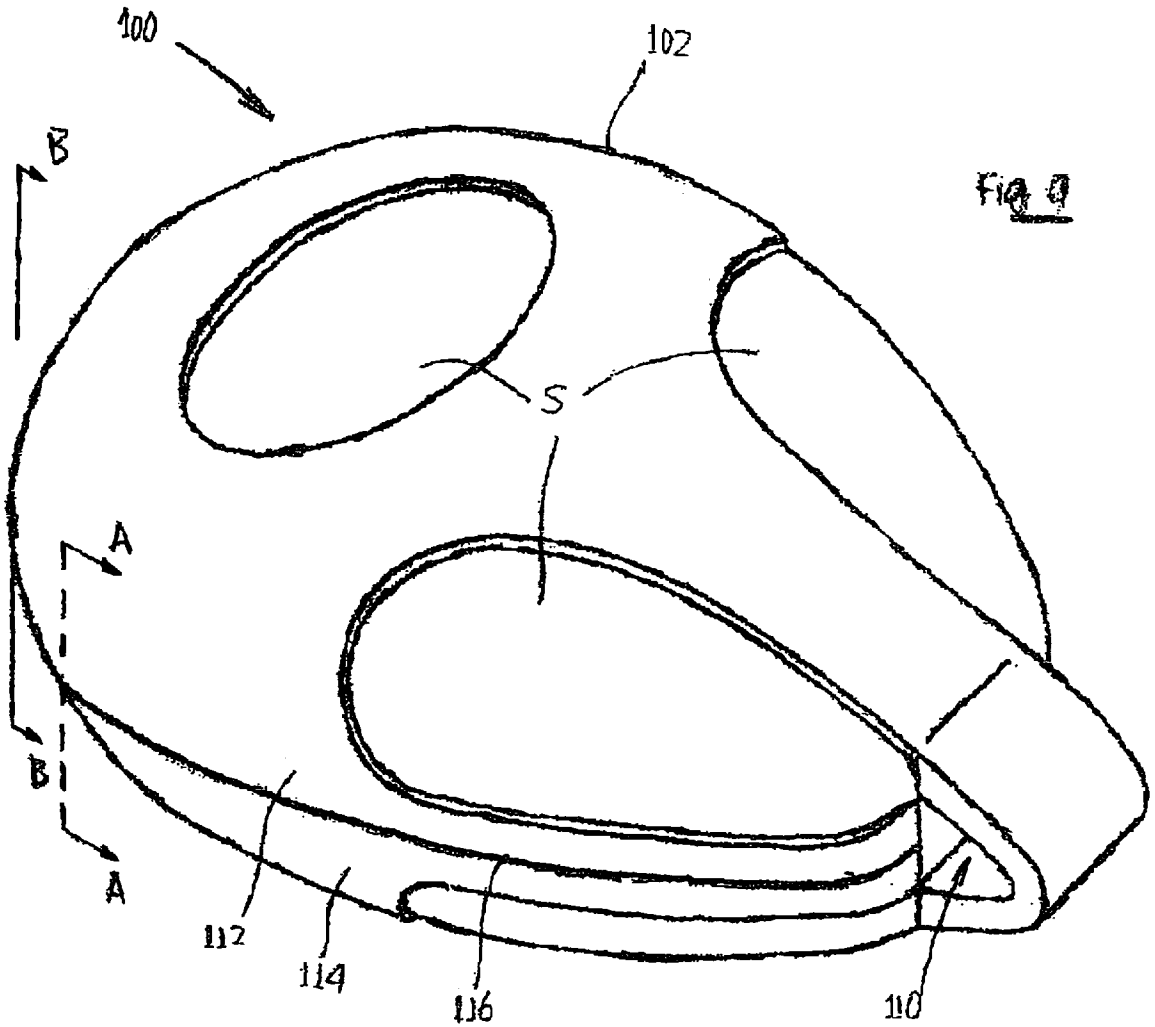
FIG. 9 shows a perspective view of the embodiment of the invention according to FIG. 8.

FIG. 9 shows a perspective view of the embodiment of the device 100 according to FIG. 8. It depicts an eye 110 for receiving detachable means, such as a ring (not shown), for attaching the holder 102 of the device 100 to an object that is to be retrieved (not shown). The holder 102 is resistant in regard of at least spray water and atmospheric humidity. In the shown embodiment, the holder 102 comprises two parts 112 and 114 which co-operate with each other in forming a closed holder. The seam 116 at the circumference along which the two halves of the holder co-operate with each other is resistant in regard of at least spray water and atmospheric humidity. One or more of the surfaces S are of a decorative nature and they can optionally be treated, for example for applying a signalling colour, an image or a reli ëf.

Figure 10B:
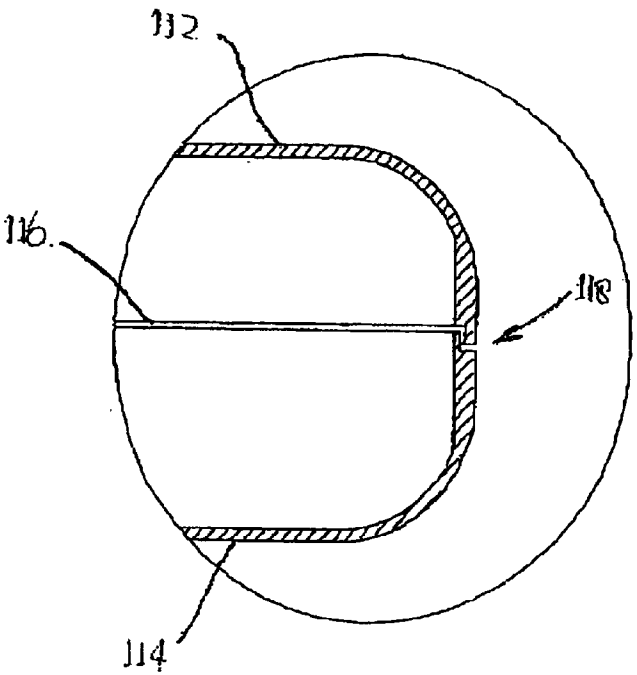
FIG. 10*b* shows a cross-sectional view along the line A—A according to FIG. 9.
Figure 10A:
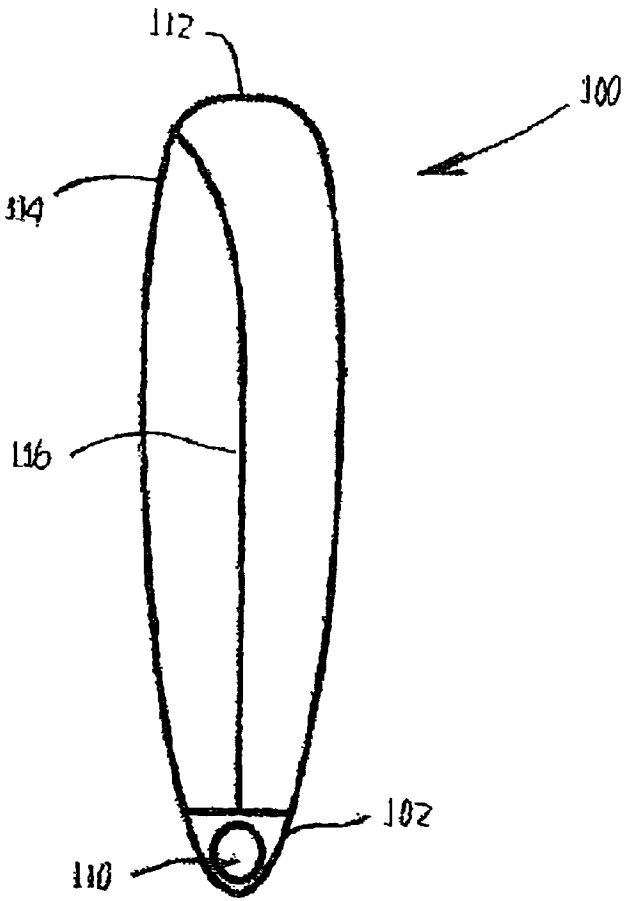
FIG. 10*a* shows a side view of a device in its closed state.

FIG. 10*a* shows a side view of yet another device in its closed state. In depiction are the two halves 112 and 114 of the holder 102, are shown, the seam 116 between the two halves and also an eye 110 through which for example a ring or strap can be fed for attaching the device 100 tot an object that is to be retrieved (not shown). FIG. 10*b* shows a cross-sectional view along the line A—A according to FIG. 9. In the closed state of the holder 102, its two halves 112 and 114 encompass, for example, a narrow labyrinth-like space 118 in between them. The narrowness of this enclosed space forms a certain minimum barrier in regard of spray water and humidity. A little spray water or a high degree of humidity in and of itself will not lead to water trickling or penetrating into the holder. First then and only when the holder is sufficiently exposed to sufficient water, such that the water has had sufficient time to reach the interior of the holder due to capillary action will this give cause to the holder opening. It shall be clear that in particular the narrowness of the seam between the two holder halves is of importance.

Figure 11:
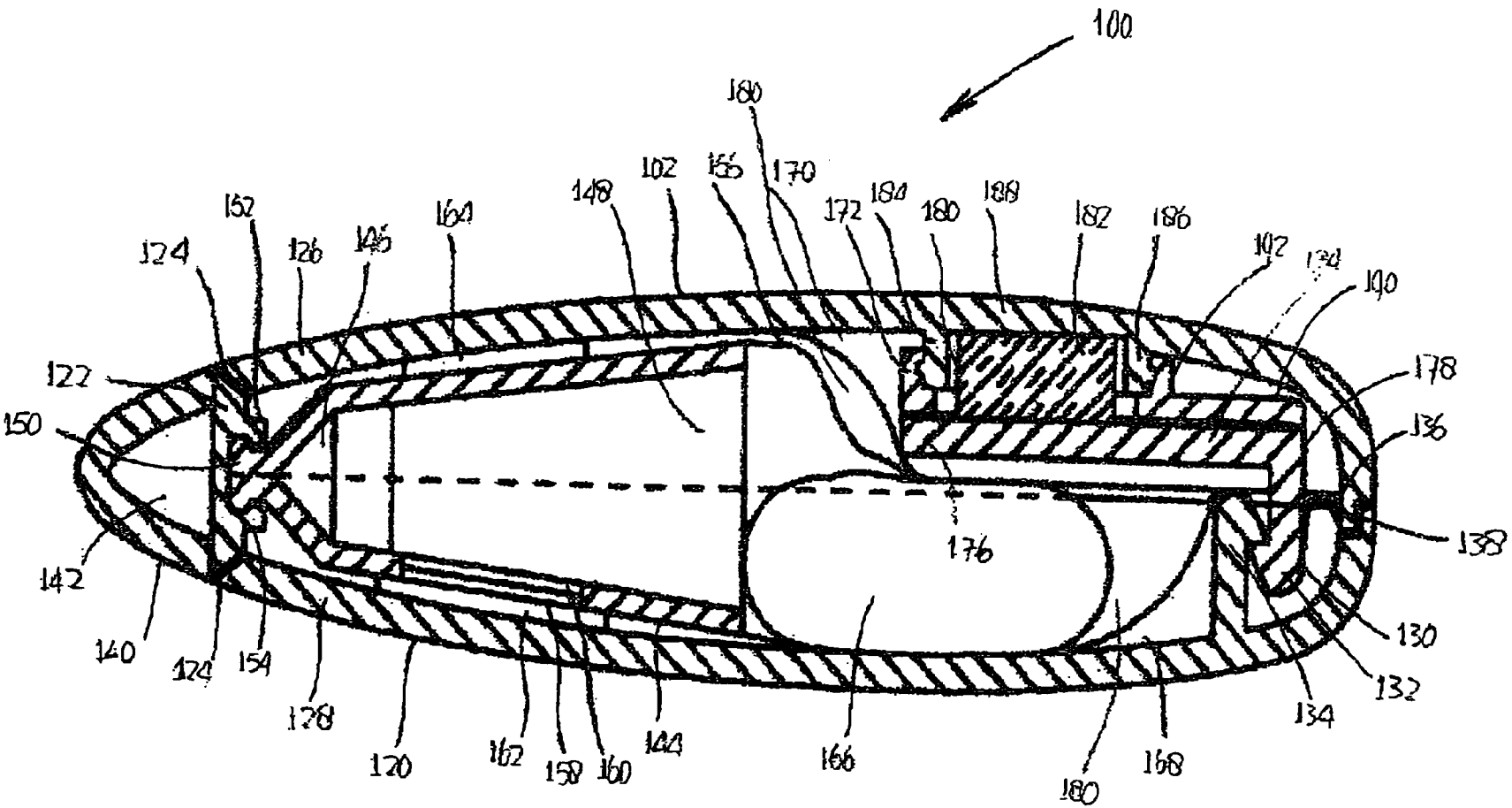
FIG. 11 shows a cross-sectional view along the line B—B of the embodiment according to FIG. 9.

FIG. 11 shows a cross-sectional view along the line B—B of the embodiment according to FIG. 9. The device 100 and the holder 102 are depicted. In this example, the holder 102 comprises a first housing ("outer housing") 120. In this example, the outer housing comprises an arm 122, which at either of its sides is connected, by means of a flexible connection, e.g. film-shaped hinges 124, to two dish-like parts 126 and 128. In the closed state of the holder, the parts 126 and 128 are kept together with the aid of a closure mechanism 130, in this example a clamping mechanism. The clamping mechanism 130 comprises two mutually co-operating members, in this example the two hooks 132 and 134 that engage each other. In order to ensure that a minimum force is required before the hooks can be moved apart, biasing means are provided as in this example a spring 136. The action of this spring is considered to be evident to the skilled person in the art. In the example that is shown, the closure mechanism 130 is provided in such a manner that it cannot be opened from the outside.

When the outer housing 120 is closed, as shown, then the two halves 126 and 128 form a seam that resistant in regard of spray water and humidity, in between them. The shape of the seam is indicated at 138. An element is also provided for on the outer housing with which the holder can be attached to an object that is to be retrieved. In the shown example this attachment element is a brace 140 that encompasses an opening 142 between itself and the rest of the holder. For example, a connecting ring (not shown) can be led through the opening to which the object that is eventually to be retrieved, can be attached.

The holder 102 further comprises a second housing 144 ("inner housing"). In the shown embodiment the inner housing has an elongate shape, such as e.g. that of a vase which widens from its closed end 146 in the direction towards its open end 148. The inner housing 144 is connected to the outer housing 120, in this example by means of a sliding member 150 that co-operates with ribs 152 and 154 and that can be secured by a click fastening, for example. The inner housing at-its open end 148 is connected to a substantially gas-impermeable inflatable body 156. This inflatable body 156 has a water-permeability property. This inflatable body comprises one or more reagents which when under the influence of water undergo a reaction to form a gas for the purpose of filling the inflatable body. Further, there is an opening 158 provided on the one longitudinal side of the inner housing 144 so that water can enter in the interior of the inner housing. Preferably, the opening 158 is in the shape of a grating 160. The grating is preferably also water-absorbing. After absorption of water, the pores of the matter of which the grating is made, can close so that the grating becomes air-tight to the extent of a pre-determined value (pressure). When, for example, reagents that are gas-forming under the influence of water are present at or near the grating, then gas formation can already begin at this point. Preferably, a seal 162 is provided between the side of the grating 160 that faces away from the inner housing and the inside of the part of the outer housing 120 that lies opposite to it. This seal 162 can e.g. be in the shape of a ring which can encompass the grating within its circumference. The surface of the inlet grating 160 can thus also be made resistant in regard of humidity. Preferably, the other longitudinal side of the inner housing is provided with biasing means 164. When the holder 102 is in its closed state, then the means 164 press the inner housing 144 against the seal 162, by which the resistance of the inner housing in respect of humidity can be further enhanced. The big advantage hereof is that the reaction potency of the gas-forming reagents, which are present in the interior of the inner housing, is sustained over a longer period of time.

The inflatable body 156 is depicted schematically in this drawing. In this example, it comprises a compartment 166 in which chemicals that react to form gas when under the influence of water, are provided. The compartment 166 is preferably made of a material that can disintegrate when under the influence of water so that the reagents within the compartment 166 can be freed. This provides for multiple reaction hearths so that faster gas formation occurs. When in action, with the shown embodiment finding itself lying in or submerged in water, then the object which is to be retrieved makes for the holder to direct itself such that the inner housing 144 finds itself below the reagent-comprising compartment 166. During disintegration of the compartment the reagents fall freely in the inner housing.

The compartment 166 itself can be divided in (sub-) compartments (not shown), whereby the reagents also are mutually separated, i.e. they can be provided in different compartments. This feature, too, enhances the spreading of the reagents so that the rate of gas formation can be regulated.

A number of other features are shown too, such as ribs and rounded sections 170 and 172 on the inside of the outer housing 120, which serve to prevent that when the holder 102 has fallen in water, that the reagent-comprising compartment 166 falls in the inner housing or, e.g. when at a further stage, that it gets stuck behind a part of the closure mechanism 130 so that the inflatable body 156 cannot unroll or unfold itself in full.

The member 174 is also pointed out. When the holder halves 126 and 128 are not kept together any longer by the closure mechanism 130, then the end 176 of the hook 178 points at an angle in the direction of the longitudinal centre-axis (the horizontal broken line) of the device. This end 176 also ensures that the inflatable body 156 stays in the free space 180 between the dishes 126 and 128. Also the rounded sections 168 and 170 provided on the inside of the outer housing ensure that the inflatable body 156 cannot adhere to the inside of the outer housing.

Further, a mechanism 180 is also shown that ensures opening of the holder 102 when sufficient water has entered the holder. This exemplary mechanism comprises a water-absorbing member 182 such as a sponge. The sponge 182 is enclosed between the ribs 184, 186 and 188 and it lies adjacent to the member 174 with respect to its side that faces the interior of the inner housing. The function of the sponge 182 is directed towards the enhancement of opening of the closure mechanism 130 when a certain threshold amount of water has come into the holder and subsequently has been absorbed by the sponge. The action of this opening mechanism will be described later.

Figure 12:
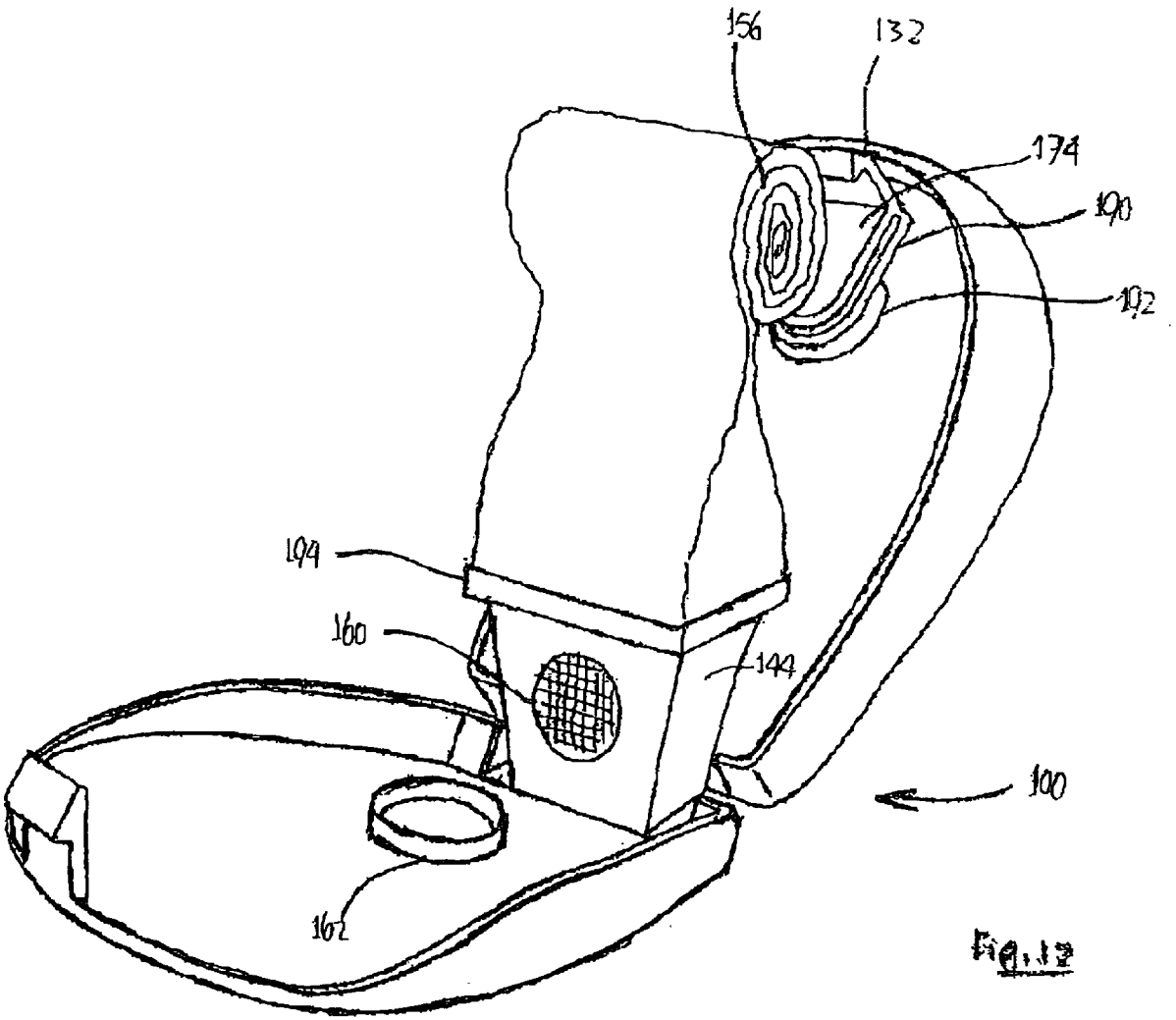
FIG. 12 shows a perspective view of the device according to FIG. 9 whereby the device is in a partly opened state.

FIG. 12 shows a perspective view of the device according to FIG. 9 whereby the device is in a partly opened state. The seal 162 can be clearly seen, just as the water inlet grating 160 on the one side of the inner housing 144. Also the transition 194 between the inner housing 144 and the inflatable body 156 can be clearly seen, just as the compact shape, in this case a rolled-up shape, in which the inflatable body has been provided within the holder. There is further shown an extra arm 190 that has been provided on the closure mechanism 130, which arm at its free end carries on to a member 192, in this example a ring, that can encompass the sponge 182 at least in part within its circumference and so that the sponge can be guided and/or restricted in its movement. When the holder 102 has fallen in water, then the rib that at that instance extends in the free space prevents that the reagent-comprising compartment 166 gets stuck behind a part of the closure mechanism 130 by which the inflatable body 156 might not be able to unroll or unfold fully.

Figure 13:
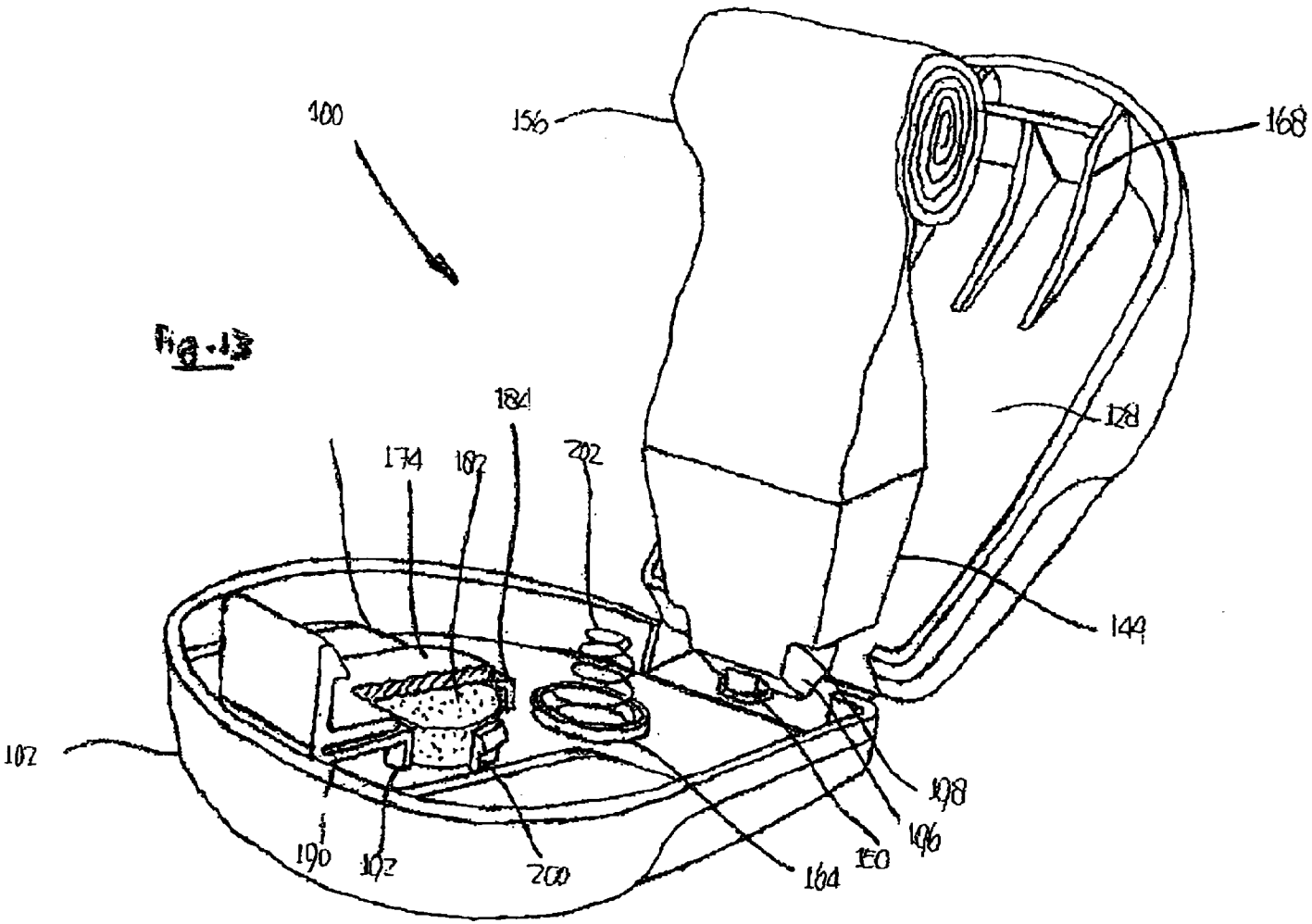
FIG. 13 depicts a perspective view comparable to that of FIG. 12, whereby the device is in a orientation of 180 degrees rotated about a horizontal axis as compared to the view according to FIG. 12.

FIG. 13 depicts a perspective view comparable to that of FIG. 12, whereby the device is in a orientation of 180 degrees rotated about a horizontal axis as compared to the view according to FIG. 12. This embodiment comprises an inner housing 144 that has a section 196 at or near its closed end which is sufficiently narrow as to prevent that a compartment wherein reagent is present can reach right up to the closed end of the inner housing by which the release of the reagents from their compartment(s) or the subsequent gas formation is retarded. Beyond the narrow section in the direction of the open end of the inner housing provision has been made for sufficient space in regard of the release of reagents from the compartment(s) or the subsequent gas formation. In the shown embodiment, sufficient space is created by means of e.g. the broadening at 198. This broadened section provides the reagents space to undergo their reaction, also when the reagents have ended up in the inner housing from out of their compartment(s). Further to be seen are a rib 200 for retaining the sponge 182 in place, as well as biasing means such as a spring 202 which, when the holder is closed, presses the inner housing 122 in the direction of the holder half 128 and specifically against the seal 162 (not shown). By this some bias is also exerted with respect to the closure mechanism 130 of the holder. This results in that when the holder is in its closed state, the closed state is maintained. When, after entry of water in the holder, the threshold value of the force to be exerted by the sponge 182 on the arm 174, e.g. an elongate hinge, is exceeded, then the closure mechanism opens and the opening is then in fact enhanced by the then relaxing spring 202. Incidentally, the sliding member 150 with which the inner housing is attached to the holder can also be made to be swivelable locally.

Figure 14:
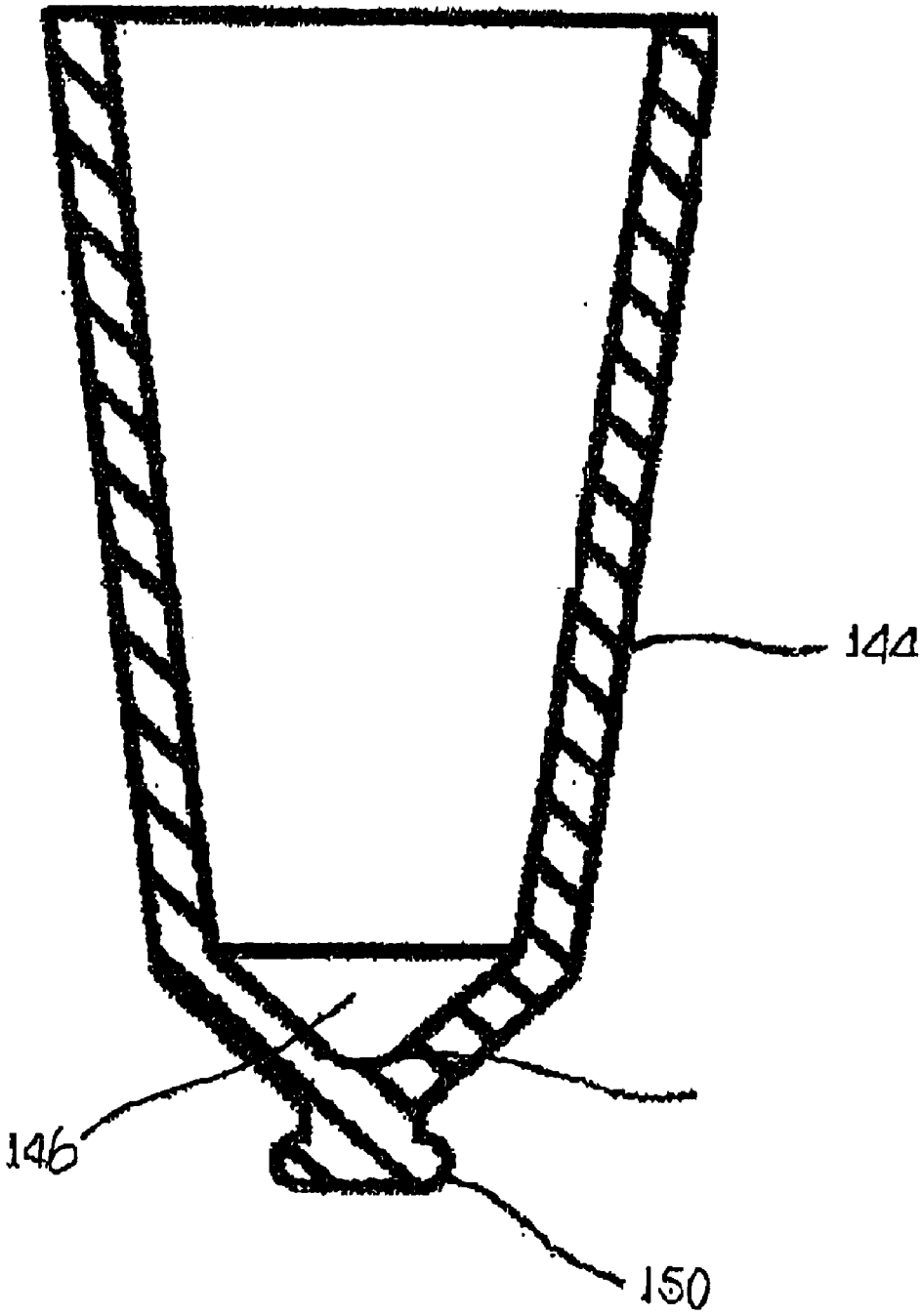
FIG. 14 shows a cross-sectional view in the longitudinal direction of the inner housing of the device according to FIG. 11.

FIG. 14 shows a cross-sectional view in the longitudinal direction of the inner housing of the device according to FIG. 11. The substantially V-shape of the closed end of the inner housing is to be noted. As mentioned before, during operation the gas-forming reagents freed from the compartment can reach this part of the inner housing. It is important that gas formation occurs also in such an event. A substantially V-shaped hearth enhances propagation of the reaction.

Figure 15:
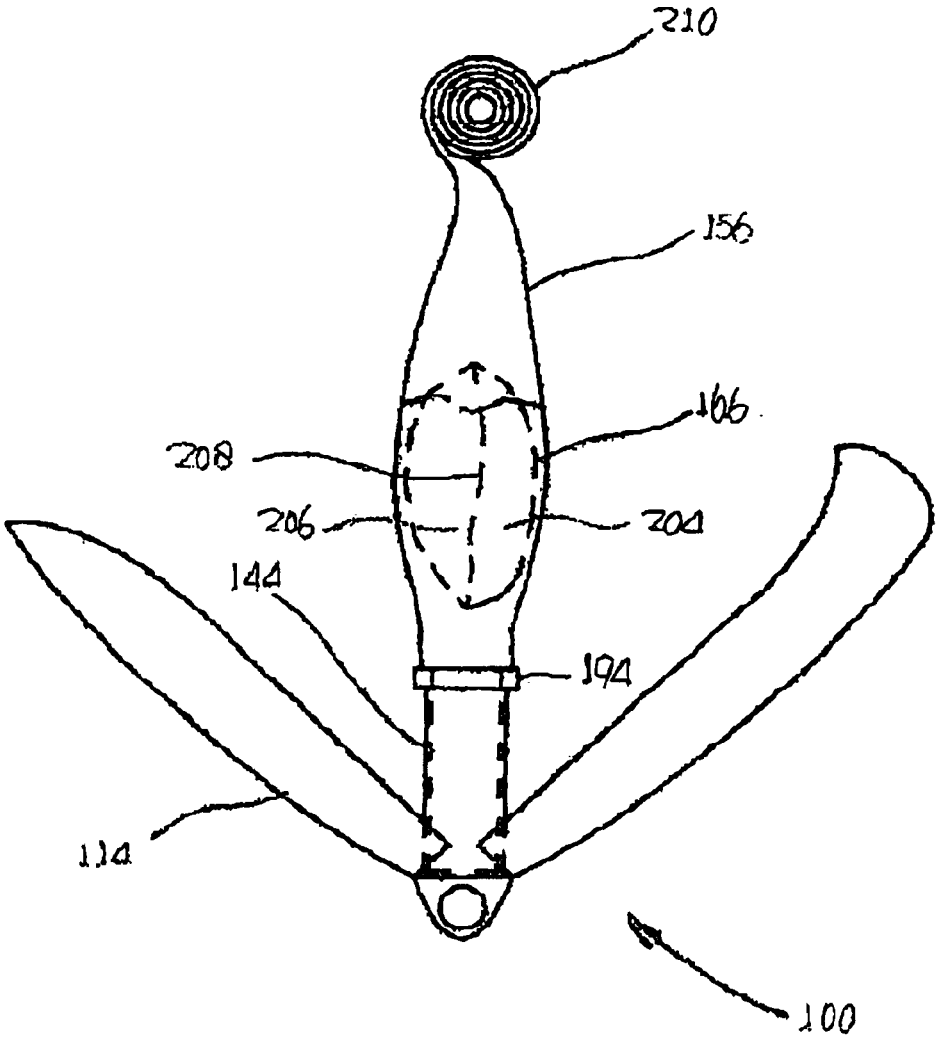
FIG. 15 shows a schematic view of a device according to the invention which is under water and in a partly opened state after the activation of the device.

FIG. 15 shows a schematic view of a device according to the invention which is under water and in a partly opened state after the activation of the device 100. It is schematically depicted that the compartment 166, in which the gas-forming reagents have been provided, comprises a number of compartments 204 and 206, whereby the compartments 204 and 206 are mutually separated by means of a water-soluble separation layer 208 the reagents required for gas formation are preferably provided in different compartments. This enhances the duration of sustainability of a proper action of the device 100. The transition 194 between the inner housing 144 and the inflatable body 156 does not per se have to be air-tight. An air-tight transition 194 does enhance the duration of sustainability of a proper action of the device 100. It is shown that the compartment 166 floats freely within the partly inflated body 156. The moveability of the compartment 166 also facilitates the unrolling or unfolding of the still compact part 210 of the inflatable body. The inflatable body is shown in a state in which it is partly unrolled. There can be optionally provided for a feature that can regulate the unrolling or unfolding of the inflatable body.

This feature can e.g. be in the form of a strip of water-soluble adhesive, e.g. gelatine or glue, that temporarily keeps two consecutive windings together so that the underlying and already unrolled part of the inflatable is first sufficiently filled.

Figure 16:
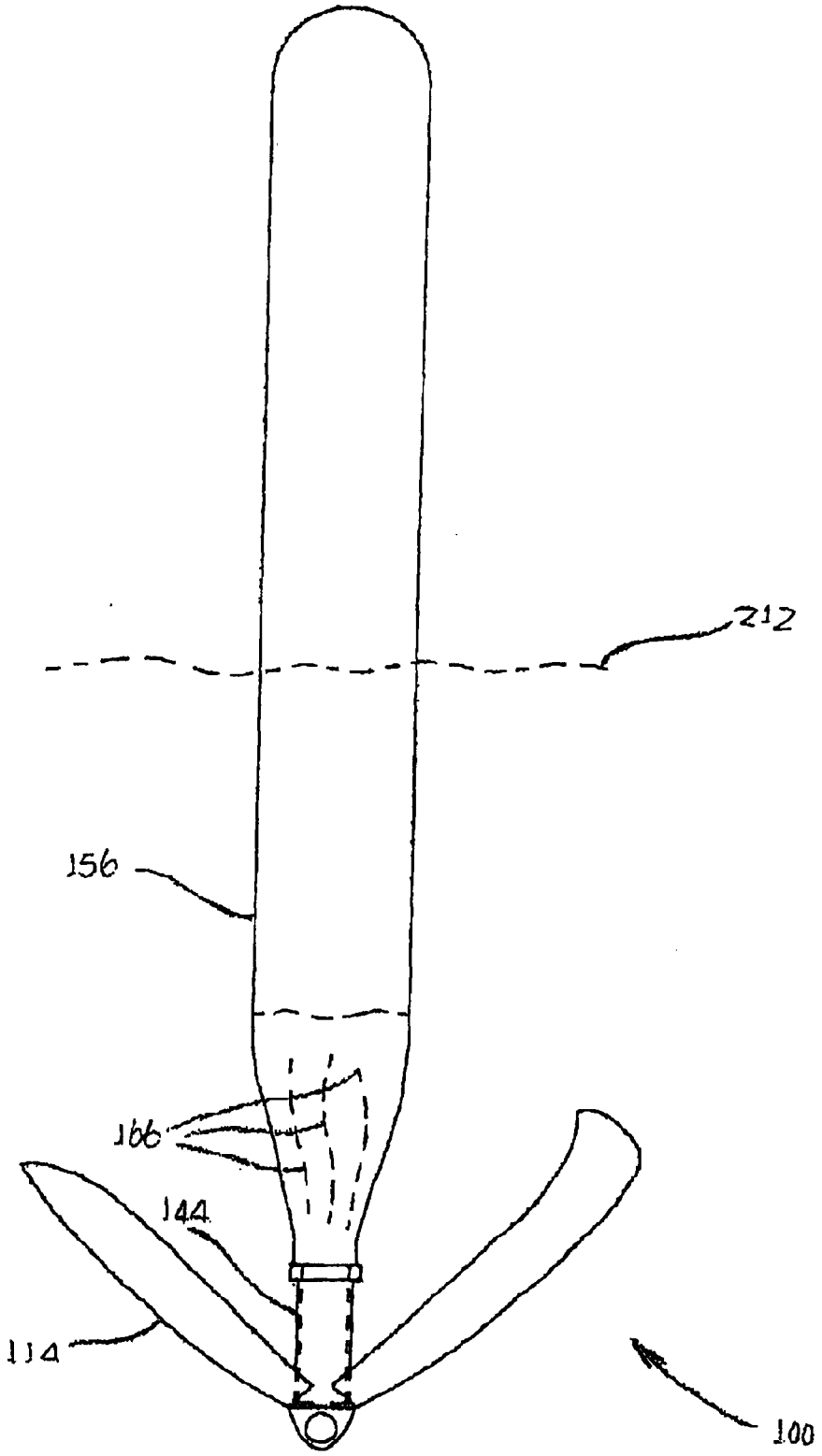
FIG. 16 depicts a schematic view of the device according to FIG. 15 whereby the device has risen to the surface and thereby is in its completely opened state.

FIG. 16 depicts a schematic view of the device according to FIG. 15 whereby the device has risen to the surface 212 and thereby is in its completely opened state. The compartment 166 is shown in a partly disintegrated state. The compartment can also be made of a material that is water-soluble, so that in due course the compartment no longer exists. The fully inflated body 156, as shown in this example, can be provided with means for e.g. signalling such as a surface in a signalling colour, or (for) locating positions, such as a miniature transponder (not shown).

The operating action of the embodiments according to FIGS. 8–16 is as follows. When the assembly of the device 100 and the object to be retrieved which is attached to the device falls in water, then after a couple of seconds water comes in inter alia the spaces 180 between the parts 16 and 128 of the holder 102. This can of course occur at any point along the seam 116 between the parts. The water that has entered the interior of the holder comes between the ribs or rim 172, 192 and 184, 186 and it is taken up by the absorption member 182. This member expands and thereby exerts a force on the arm 174 of the closure mechanism 130. At a certain threshold value of this exerted force the hook 132 is moved away from the hook 134, against the bias of the spring 136. By this the two parts 126 and 128 come to lie spaced apart by which the water now also can reach the opening 158 and the inlet grating 160. Water then also enters in the inner housing 144 so that it also reaches the compartment 166 in which the gas-forming reagents (not shown) are comprised. The compartment 166 lets water through after which, eventually after a separation layer present between the sub-compartments has disintegrated or dissolved, it allows the reagents to be freed. The compartment 166, or at least a part thereof, can hereby be displaced under the influence of the gravitational force and a flotation force exerted by the gas which is being formed. A part of the reagents undergoes reaction and another part sinks in the direction of the closed end 146 of the inner housing 144. In the meantime, gas formation occurs whereby the inflatable body 156 increasingly comes out of its compact state, not only due to the formed gas and the eventually freely floating compartment 166, but also enhanced by the spontaneous unrolling or unfolding of the inflatable body. At a given stage, so much gas has been formed that the flotation or driving force exerted by the filled inflated body counters at least the downward forces acting on the assembly of the device 100 and the object to be retrieved, so that the assembly does not sink further and soon rises to the surface.

Incidentally, the reagent-comprising compartment 166 can be provided outside the inflatable body 156 and inside the inner housing 144. The compartment 166 thereby may be optionally attached to the inner housing 144 such embodiments will also work provided the material of which the compartment 166 can dissolve or disintegrate in water.

The invention offers solutions for floating a diversity of objects, varying from lightweight pairs of spectacles to heavy vehicles. Three particularly important insights on which the above-described invention is based, are the fast release of an inflatable body provided in a compact state when a certain threshold value of wetting of the device is exceeded, use of the inflatable body itself for a fast activation of a gas-forming reaction that is required for the flotation or driving force which is to be exerted, and keeping the reagents required for gas formation separated in a stable manner. There are numerous possible uses and embodiments imaginable which are considered to fall within the framework of the above-described invention.

What is claimed is:

1. Device for use in retrieving an object that falls in water or in saving a person who falls in water, whereby the device is provided with:

means for attaching the device to the object to be retrieved or means with which the person to be saved can carry the device with him, respectively, a spray water-resistant holder that comprises a mechanism for opening of the holder, which holder in its closed state encompasses an empty, inflatable body of a substantially gas-impermeable matter in a folded state, and one or more reagents which react under the influence of water that has entered the holder to form a gas, which gas serves for filling the folded inflatable body in order to exert a flotation or driving force on the object attached to the device or on the person carrying the device characterized in that the reagents which under the influence of water form gas are comprised within the substantially gas-impermeable inflatable body itself and (that) the inflatable body comprises a water-permeable substance.

2. Device according to claim 1, characterized in that the water-permeable substance of the substantially gas-impermeable and inflatable body is water-absorbing.

3. Device according to claim 1 or 2, characterized in that the water-permeable substance of the substantially gas-impermeable and inflatable body has a predetermined overpressure-releasing function.

4. Device according to claim 1, characterized in that the substantially gas-impermeable and inflatable body comprising a water-permeable substance is provided with a swelling agent.

5. Device according to claim 1, characterized in that the water-permeable substance is porous and comprises a swelling agent that substantially closes the pores when water is absorbed.

6. Device according to claim 1, characterized in that the inflatable body comprises in part a water-permeable substance and in part a plastic.

7. The device of claim 6 wherein said plastic is polypropene.

8. The device of claim 6 wherein said plastic is polyethene.

9. Device according to claim 1, characterized in that the inflatable body as in its folded state can be provided with means for enhancing the eventual unfolding of the inflatable body.

10. The device of claim 9 wherein said enhancing means comprises a string.

11. The device of claim 9 wherein said enhancing means comprises a spring.

12. Device according to claim 1, characterized in that the inflatable body is divided into compartments and it is provided in one or several of these compartments with one or more reagents that react under the influence of water that has entered the holder to form the gas that causes a flotation or driving force.

13. Device according to claim 12, characterized in that the one or more reagents that react under the influence of water to form the gas that brings about a flotation or driving force, are mutually separated within the compartment in which they have been provided.

14. Device according to claim 13, characterized in that the mutual separation of the reagents comprises a water-soluble substance.

15. The device of claim 14 wherein said substance is in a separator layer.

16. Device according to claim 12, characterized in that the arrangement of the compartments, and within the compartments (the arrangement of) the one or more reagents which react under the influence of water entering the inflatable body to form the gas that causes a flotation or driving force is such, that the gas formed at the start of the reaction can fill the body partly and thereby bring about a draught or "chimney" effect by which the reaction can propagate.

17. Device according to claim 16, or a device for use in retrieving an object that falls in water or in saving a person who falls in water, whereby the device is provided with:

means for attaching the device to the object to be retrieved or means with which the person to be saved can carry the device with him, respectively, a spray water-resistant holder that comprises a mechanism for opening of the holder, which holder in its closed state encompasses an empty, inflatable body of a substantially gas-impermeable matter in a folded state, and one or more reagents which react under the influence of water that has entered the holder to form a gas, which gas serves for filling the folded inflatable body in order to exert a flotation or driving force on the object attached to the device or on the person carrying the device, characterized in that the mechanism for the opening of the spray water-resistant holder comprises at the outer surface of the holder a substance that is not soluble in humidity and soluble in water.

18. Device according to claim 17, characterized in that the layer of the substance that is not soluble in humidity and soluble in water comprises a substantial part of the outer surface of the spray water-resistant holder.

19. Device according to claim 17, characterized in that the spray water-resistant holder comprises a water-soluble plastic foil.

20. The device of claim 19 wherein said foil comprises a printable surface.

21. The device of claim 19 wherein said foil is biodegradable.

22. Device according to claim 1, characterized in that the device has an elongate shape or a zig-zagged shape, so that it can be attached to the object.

23. The device of claim 22 wherein the object is a pair of spectacles with an arm and the device is attributed to the arm of the spectacle.

24. A life jacket or an item of clothing that is provided with a device according to claim 1.

25. The device of claim 24 wherein the items of clothing is a skirt.

26. The device of claim 24 wherein the item of clothing is a pair of trousers.

27. Device according to claim 1, provided on a vehicle or vessel for exerting a flotation or driving force on one or more parts of the vehicle or vessel.

28. Method of manufacturing a device according to claim 1, characterized in that the method comprises the following steps:

forming an outer layer of matter, which in regard of its mechanical strength and rate of dissolution in water is suitable for the side of the device that is to be eventually exposed to water, in a mold providing adjacent to the outer layer a layer of water-permeable substance, providing an inner layer of water-soluble substance having a lower melting temperature than that of the outer layer, on the side adjacent to the layer of water-permeable substance and facing away from the outer layer, and applying heat and/or pressure for melting the three layers such that the matter of the inner layer is melted into the layer of water-permeable substance.

29. The method of claim 28 wherein the water permeable substance is water-absorbing.

30. The device of any of claims 14, 17 or 28 wherein said substance comprises polyvinylalcohol.

31. Device suitable for use in retrieving an object, that falls in water, whereby the device is provided with:

means for attaching the device to the object to be retrieved, a holder which comprises a mechanism for the closure and opening of the holder, which holder in its closed state encloses an inflatable body; and one or more reagents which react under the influence of water that has entered the holder to form a gas, which gas serves for filling a folded inflatable body in order to exert a flotation or driving force on the object attached to the device, characterized in that the holder is resistant in regard of spray water and atmospheric humidity, the holder in its closed state encloses an empty, substantially gas-impermeable body, and the reagents which under the influence of water form gas are comprised within the substantially gas-impermeable inflatable body itself.

32. Device according to claim 31, characterized in that the inflatable body is divided into compartments and it is provided in one or several of these compartments with one or more reagents that react under the influence of water that has entered the holder to form the gas that causes a flotation or driving force.

33. Device according to claim 32, characterized in that the one or more reagent-comprising compartments provided in the inflatable body are freely floatable.

34. Device according to any of claims 31 or 32, characterized in that the one or more reagents that react under the influence of water to form the gas that brings about a flotation or driving force, are mutually separated within the compartment in which they have been provided.

35. Device according to claim 34, characterized in that the mutual separation of the reagents is water-soluble or can disintegrate in water.

36. The device of claim 31 whereas the object is a GPS device.

37. Device according to claim 31, characterized in that the arrangement of the compartments, and within the compartments (the arrangement of) the one or more reagents which react under the influence of water entering the inflatable body to form the gas that causes a flotation or driving force is such, that the gas formed at the start of the reaction can fill the body partly and thereby bring about a draught or "chimney" effect by which the reaction can propagate.

38. Device according to claim 31, characterized in that the holder is provided as a first housing ("outer housing") which comprises a second housing ("inner housing"), whereby the second housing is provided with a water-permeable opening, and whereby the second housing is provided between the inflatable body and the first housing.

39. Device according to claim 38, characterized in that the water-permeable opening of the second housing can be closed air-tight.

40. Device according to claim 39, characterized in that the water-permeable opening of the second housing can be closed air-tight by means of a pressing member.

41. The device of claim 40 wherein the pressing member comprises a spring.

42. Device according to claim 38, characterized in that a part of the second housing is provided as an elongate member, whereby the elongate member has a closed end and at its other end provides a connection to the inflatable body.

43. The device of claim 42 wherein said closed end is substantially V-shaped.

44. Device according to claim 38, characterized in that the second housing comprises sections of varying breadths.

45. Device according to claim 44, characterized in that the second housing a narrow section at or near its part with the closed end and comprises a broad section at or near the part of its other end.

46. Device according to claim 32, characterized in that the closure mechanism of the holder is provided with a number of mutually engaging hooks.

47. The device of claim 46 wherein said closure mechanism comprises a mechanism for biasing the hooks in the closed state of the holder.

48. Device according to claim 32, characterized in that the holder is provided with means that expand in the presence of water, said means, when the holder opens exerting a force on the closure for enhancing the opening of the holder.

49. Device according to claim 32, characterized in that the holder has sides and is provided on its inside with rib means and curved surface sections for keeping the inflatable body away from the sides of the holder.

50. The device of claims 1 or 32 further comprising means for detaching said device attaching means.

51. The device of claims 22 or 31 wherein the object is a key ring.

* * * * *